US006359993B2

(12) United States Patent
Brimhall

(10) Patent No.: US 6,359,993 B2
(45) **Date of Patent: *Mar. 19, 2002**

(54) CONFORMAL TIP FOR A HEARING AID WITH INTEGRATED VENT AND RETRIEVAL CORD

(75) Inventor: Owen D. Brimhall, South Jordan, UT (US)

(73) Assignee: Sonic Innovations, Salt Lake City, UT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 45 days.

(21) Appl. No.: 09/231,266

(22) Filed: Jan. 15, 1999

(51) Int. Cl.[7] ..... H04R 25/01
(52) U.S. Cl. ..... 381/328; 381/322
(58) Field of Search ..... 381/322, 324, 381/325, 328

(56) References Cited

U.S. PATENT DOCUMENTS

| | | | | |
|---|---|---|---|---|
| 3,665,122 A | | 5/1972 | Weiss | 179/107 BC |
| 4,375,016 A | | 2/1983 | Harada | 179/182 R |
| 4,553,627 A | | 11/1985 | Gastmeier et al. | 181/135 |
| 4,569,812 A | | 2/1986 | Werwath et al. | 264/294 |
| 4,712,245 A | * | 12/1987 | Lyregaard | 381/68.6 |
| 4,756,312 A | | 7/1988 | Epley | 128/420.5 |
| 4,852,177 A | | 7/1989 | Ambrose | 381/154 |
| 4,879,750 A | | 11/1989 | Nassler | 381/68.6 |
| 4,880,076 A | | 11/1989 | Ahlberg et al. | 181/130 |
| 4,937,876 A | | 6/1990 | Biërmans | 381/68.6 |
| 5,002,151 A | | 3/1991 | Oliveira et al. | 181/130 |
| 5,031,219 A | | 7/1991 | Ward et al. | 381/68.6 |
| 5,068,902 A | * | 11/1991 | Ward | 381/68.6 |
| 5,084,224 A | | 1/1992 | Watters | 264/155 |
| 5,099,947 A | | 3/1992 | Guggenberger et al. | 181/130 |
| 5,105,904 A | | 4/1992 | Olsen | 181/128 |
| 5,146,051 A | * | 9/1992 | Hermann | 181/130 |
| 5,166,659 A | | 11/1992 | Navarro | 381/68.6 |
| 5,201,007 A | | 4/1993 | Ward et al. | 381/68.6 |
| 5,203,352 A | | 4/1993 | Gardner, Jr. | 128/864 |
| 5,293,008 A | | 3/1994 | Danielsen | 181/135 |
| 5,321,757 A | * | 6/1994 | Woodfill, Jr. | 381/322 |
| 5,327,500 A | | 7/1994 | Campbell | 381/68.6 |
| 5,395,168 A | | 3/1995 | Leenan | 381/68.6 |
| 5,401,920 A | | 3/1995 | Oliveira | 181/135 |
| 5,440,082 A | | 8/1995 | Claes | 181/135 |
| 5,682,020 A | | 10/1997 | Oliveira | 181/130 |
| 5,701,348 A | * | 12/1997 | Shennib et al. | 381/68.6 |
| 5,825,896 A | | 10/1998 | Leedom | 381/69 |
| 5,875,254 A | * | 2/1999 | Hanright | 381/329 |
| 5,881,159 A | | 3/1999 | Aceti et al. | 381/328 |
| 5,920,636 A | | 7/1999 | Oliveira et al. | 381/328 |
| 5,996,584 A | | 12/1999 | Oliveira et al. | 128/864 |
| 6,097,826 A | * | 8/2000 | Clavadetscher et al. | 381/324 |
| 6,179,085 B1 | * | 1/2001 | Brimhall et al. | 181/135 |

FOREIGN PATENT DOCUMENTS

| | | |
|---|---|---|
| DE | 43 39 899 | 6/1995 |
| WO | WO 99 13686 | 3/1999 |

* cited by examiner

*Primary Examiner*—Stella Woo
*Assistant Examiner*—P. Dabney
(74) *Attorney, Agent, or Firm*—Lyon & Lyon LLP

(57) ABSTRACT

A completely in-the-canal hearing device including a conformal tip and a combination vent and retrieval cord is disclosed. The vent and retrieval cord allows pressure equalization between the deep portions of the ear canal and the ambient air. In addition, the vent and retrieval cord allows a user to easily insert and remove the hearing device without the use of auxiliary tools. The vent tube also contributes to the reduction of acoustic feedback.

14 Claims, 5 Drawing Sheets

CONFORMAL TIP FOR A HEARING AID WITH INTEGRATED VENT AND RETRIEVAL CORD

FIELD OF THE INVENTION

The present invention pertains to hearing aids. More particularly, the present invention pertains to conformal tips for hearing aids.

BACKGROUND OF THE INVENTION

The modern trend in the design and implementation of hearing devices is focusing to a large extent on reducing the physical size of the hearing device. Miniaturization of hearing device components is becoming increasingly feasible with rapid technological advances in the fields of power supplies, sound processing electronics and micromechanics. The demand for smaller and less conspicuous hearing devices continues to increase as a larger portion of our population ages and faces hearing loss. Those who face hearing loss also encounter the accompanying desire to avoid the stigma and self consciousness associated with this condition. As a result, smaller hearing devices which are cosmetically less visible are increasingly sought after.

Hearing device technology has progressed rapidly in recent years. First generation hearing devices were primarily of the Behind-The-Ear (BTE) type, where an externally mounted device was connected by an acoustic tube to a molded shell placed within the ear. With the advancement of component miniaturization, modern hearing devices rarely use this Behind-The-Ear technique, focusing primarily on one of several forms of an In-The-Canal hearing device. Three main types of In-The-Canal hearing devices are routinely offered by audiologists and physicians. In-The-Ear (ITE) devices rest primarily in the concha of the ear and have the disadvantages of being fairly conspicuous to a bystander and relatively bulky to wear. Smaller In-The-Canal (ITC) devices fit partially in the concha and partially in the ear canal and are less visible but still leave a substantial portion of the hearing device exposed. Recently, Completely-In-The-Canal (CIC) hearing devices have come into greater use. As the name implicates, these devices fit deep within the ear canal and are essentially hidden from view from the outside.

In addition to the obvious cosmetic advantages these types of in-the-canal devices provide, they also have several performance advantages that larger, externally mounted devices do not offer. Placing the hearing device deep within the ear canal and proximate to the tympanic membrane (ear drum) improves the frequency response of the device, reduces distortion due to jaw extrusion, reduces the occurrence of the occlusion effect and improves overall sound fidelity.

The shape and structure, or morphology, of the ear canal varies from person to person. However, certain characteristics are common to all individuals. When viewed in the transverse plane, the path of the ear canal is extremely irregular, having several sharp bends and curves. It is these inherent structural characteristic which create problems for the acoustic scientist and hearing device designer.

For general discussion purposes, the ear canal can be broken into three main segments. The external and medial segments are both surrounded by a relatively soft cartilaginous tissue. The external segment is largely visible from the outside and represents the largest cavity of the ear canal. The innermost segment of the ear canal, closest to the tympanic membrane, is surrounded by a denser bony material and is covered with only a thin layer of soft tissue. The bony material allows for little expansion to occur in this region compared with the cartilaginous regions of the external and medial segments of the ear canal. In addition to being surrounded by cartilage rather than bone, these areas are covered with a substantially thicker tissue layer. As such, pressure exerted by an ITC hearing device on the inner bony region of the canal can lead to discomfort and/or pain to an individual, especially when a deep insertion technique is used.

Since the morphology of the ear canal varies so greatly from person to person, hearing aid manufacturers and audiologists have employed custom manufactured devices in order to precisely fit the dimensions of each user's ear canal. This frequently necessitates impressions of the user's ear canal to be taken. The resulting mold is then used to fabricate a rigid hearing device shell. This process is both expensive and time consuming and the resulting rigid device shell does not perform well during the deformations of the ear canal shape that occurs during normal jaw movement. In order to receive a properly fit hearing device, the user typically has to make several trips to the audiologist for reshaping and resizing. Even after the best possible fit is obtained, the rigid shell rarely provides comfortable hearing enhancement at all times.

Further, because the resulting hearing aid device shell is typically formed from a hard acrylic material, discomfort to the user is typical when worn for extended periods of time. The inability of the hard shell to conform to normal ear canal deformations can cause it to become easily dislodged from its proper position. Consequently, the quality of the hearing enhancement suffers. Furthermore, due to the added manufacturing costs, it is desirable to utilize a hearing device that is at least partially formed from an off-the-shelf or preformed component readily available to the audiologist or physician.

While the performance of CIC hearing devices are generally superior to other larger and less sophisticated devices, several problems remain prevalent. Complications typically arise as a result of the small size of CIC hearing devices and the depth to which they are inserted into a user's ear canal.

For example, because a CIC hearing device forms an essentially air tight seal between the tip of the hearing device and the walls of the ear canal, discomfort to a user is common. This acoustic seal prevents the equalization of pressure between the internal chamber formed between the tympanic membrane and the hearing device, and the ambient environment. Due to the sensitivity of the tympanic membrane, even small pressure differentials can cause severe discomfort.

Further, due to their small size and positioning within the ear canal, CIC hearing devices can cause handling problems, making insertion and removal by a user difficult and cumbersome.

U.S. Pat. No. 5,701,348, entitled "Articulated Hearing Device" ("the '348 patent"), discloses a segmented hearing device with several articulating and non-contiguous parts. The hearing device of the '348 patent includes a rigid receiver module with a surrounding acoustic seal. The acoustic seal of the '348 patent includes a sheathing made from a singular piece of foam or silicone which compresses when inserted into the deep regions of an ear canal. The '348 patent also describes the use of this sealing mechanism as an anchor so that the remaining articulating components of the hearing device can move freely and adjust to the changing morphology of the ear canal.

While generally conforming to the shape of an ear canal when inserted, this device still presents comfort problems during insertion and removal due to its single piece construction of the sealing mechanism. Also, due to the single piece construction of this sealing device, the quality of the acoustic seal degrades over time and during prolonged use. The ability to effectively interchange and clean the sealing material is also compromised. Further, the device taught by the '348 patent is not conducive to use with a completely in the canal hearing device (CIC) where the acoustic seal is the only point of contact with the ear canal. Compression of the sealing material reduces the volume of the foam and the sealing properties are accordingly diminished.

U.S. Pat. No. 5,395,168, entitled "In the Ear Hearing Aid Having Extraction Tube Which Reduces Acoustic Feedback" ("the '168 patent"), discloses an in-the-ear hearing device which incorporates a retrieval system mechanically attached to the hearing device body. The retrieval cord is also presented as a hollow acoustic tube to aid in reducing acoustic feedback. In order to reduce acoustic feedback, the acoustic tube disclosed in the '168 patent extends into the receiver housing and engages with the receiver elements.

While aiding in the reduction of acoustic interference, this device also presents comfort problems during insertion and removal due to the lack of a venting or pressure equalization system between the inner chamber formed by the hearing device, and the ambient environment.

SUMMARY OF THE INVENTION

In accordance with a first aspect of the invention, an in-the-canal hearing device comprising a first module, e.g., housing a microphone and sound processing electronics, is removably attached to a second module, e.g., housing an audio speaker. An elongate tubular body is secured to the first module and defines a first lumen, the tubular body has a proximal opening in communication with the first lumen. A second lumen extends through the second module, the second module having a distal end opening in communication with the second lumen. The tubular body is removably attached to the second module such that the first and second lumens are in communication to form a conduit extending from the proximal tubular body opening to the distal end opening of the second module.

In accordance with another aspect of the invention, an in-the-canal hearing device comprises a receiver module and a conformal tip. An elongate tubular body is attached to and extends from the conformal tip, the tubular body has a proximal and a distal opening and a first lumen extending there between. The conformal tip has a proximal opening, a distal opening and a second lumen extending there between. The tubular body is attached to the conformal tip such that the first and second lumens are in communication to thereby form a conduit extending from the proximal opening of the tubular body to the distal opening of the conformal tip.

In accordance with a further aspect of the invention, the conduit formed by the respective first and second lumens attenuates acoustic feedback when the device is positioned in an ear canal. In accordance with a still further aspect of the invention, the conduit also provides a pressure equalization vent when the device is positioned within an ear canal.

In a first preferred embodiment, the respective first module and tubular body are attached to the second module in a manner allowing the second module to rotate relative to the first module. In a second preferred embodiment, the tubular body extends from the first module in a direction distal to the second module, such that the tubular body provides a mechanism to facilitate removal of the hearing device from an ear canal.

Other and further aspects and advantages of the invention will become apparent hereinafter.

BRIEF DESCRIPTION OF THE DRAWINGS

The drawings illustrate both the design and utility of the preferred embodiments of the present invention, in which similar elements in different embodiments are referred to by the same reference numbers for purposes of ease in illustration of the invention, wherein.

DETAILED DESCRIPTION OF THE PREFERRED EMBODIMENTS

Figure 1:
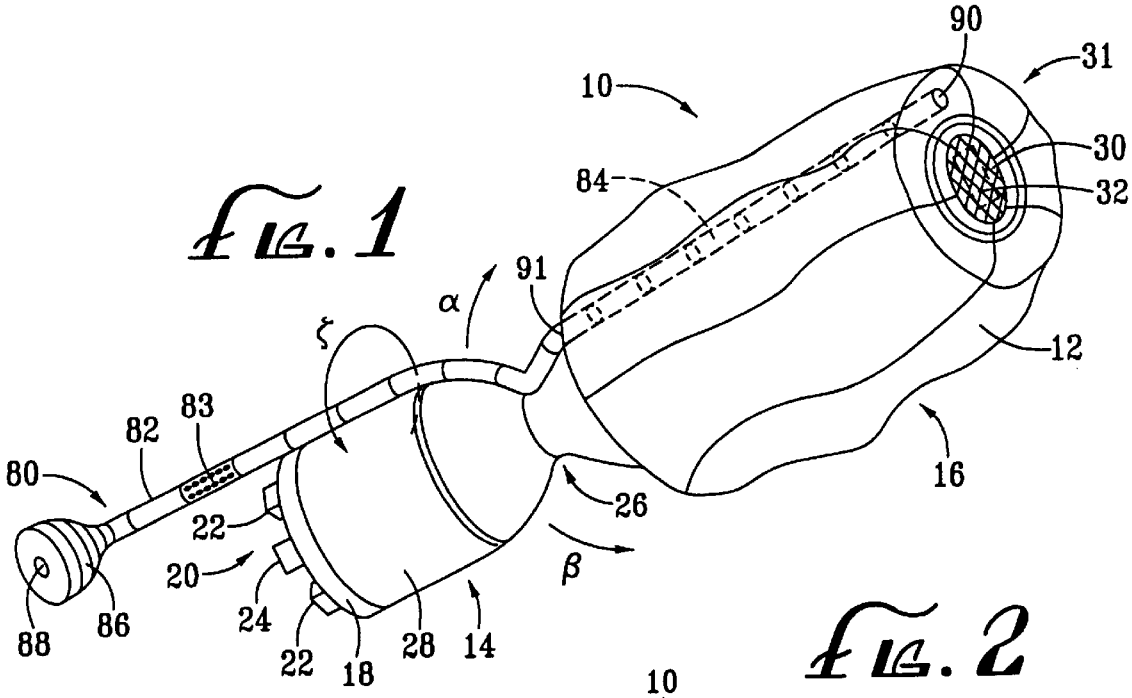
FIG. 1 is a perspective view of a first preferred embodiment of a completely in-the-canal (CIC) hearing device utilizing a conformal tip constructed in accordance with the present invention.

FIG. 1 shows a perspective view of a completely in-the-canal (CIC) hearing device 10 utilizing a preferred embodiment of a conformal tip 12. The CIC hearing device 10, includes a main module 14 connected to a receiver module 16 by an articulating joint 26, which allows the main module 14 to pivot and rotate relative to the receiver module 16. Possible directions of movement of the main module 14 are represented by arrows $\alpha$, $\beta$ and $\delta$.

The main module 14 preferably comprises a rigid shell 28 formed, e.g., from a plastic, thermoplastic or other polycarbonate material. The rigid shell (or housing) 28 provides a lightweight, durable, bio-compatible housing for internal components of the main module 14, including a power source 36 and sound processing electronics 46 (seen in FIG. 2). Alternately, the main module 14 can be formed from a medical grade stainless steel or other bio-compatible and moisture resistant material. Notably, the housing 28 provides protection of the internal components from moisture, dirt, and oil from cerumen (ear wax).

The main module 14 further includes a removable faceplate 18 covering an open end 20 of the housing 28 distal to the articulating joint 26. The faceplate 18 allows access to the components mounted inside of the main module 14. Located on the exterior of the faceplate 18 are controls 22 and a microphone 24. Briefly, the controls 22 provide the ability to adjust volume, sensitivity, or sound processing schemes.

The conformal tip 12 substantially surrounds the exterior surface of the receiver module 16. In particular, the conformal tip 12 mounts and acoustically seals the hearing device 10 within the deep bony region of the ear canal and in close proximity to the tympanic membrane. Exposed on the distal end 31 of the receiver module 16 is a replaceable filter 30. A speaker 32 (shown as broken lines located behind the filter 30) operates within the receiver module 16.

A conduit 80 serves as both a vent and a retrieval cord for the hearing device 10, and additionally aids in minimizing acoustic feedback. The conduit 80 comprises a proximally extending tubular body portion 82 mounted along the external surface of the main module 14, and an internal distal lumen portion 84 extending through the conformal tip 12. The tubular body portion 82 forms an internal lumen 83 extending from a proximal opening 88 of the tubular body portion 82 to a proximal opening 91 of the internal lumen portion 84. The internal lumen portion 84 extends from its proximal opening 91 to a distal opening 90 located in the distal end 31 of the receiver module 16. The respective lumens 83 and 84 are in communication with each other to thereby form a substantially uniform passage from the proximal opening 88 of the tubular body portion 82 to the distal opening 90 of the internal lumen. The proximal portion of the tubular body 82 is preferably formed from a substantially rigid material and is physically bonded to the main module 14.

In particular, when the hearing device 10 is inserted deeply into an ear canal, the conduit 80 allows air and sound waves to flow freely between a chamber formed between the distal end 31 of the receiver module 16 and the tympanic membrane, and the ambient air. Due to the air tight seal formed between the conformal tip 12 and the ear canal wall, pressure builds up in the deep portion of the ear canal, near the tympanic membrane (indicated by reference number 98 in FIG. 5). The passage created by the conduit 80 prevents an increase in this pressure by acting as a vent between the deep portions of the ear canal and the ambient air.

In addition to providing a pressure vent for the hearing device 10, the conduit 80 also allows a user, physician or audiologist to easily insert and remove the hearing device 10 from within the ear canal. In particular, the proximal end of tubular body portion 82 extends proximally (i.e., towards the opening of the ear when the device is inserted in an ear canal) beyond the operative end 20 of the main module 14. This proximally extending portion of the tubular body portion 82 is preferably long enough so that the wearer can grasp it securely between two fingers and remove (i.e., pull) the hearing device 10 from the ear canal. The proximal end of the tubular body portion 82 includes a circumferentially raised section 86 to further aid a user in grasping the conduit 80.

Figure 2:
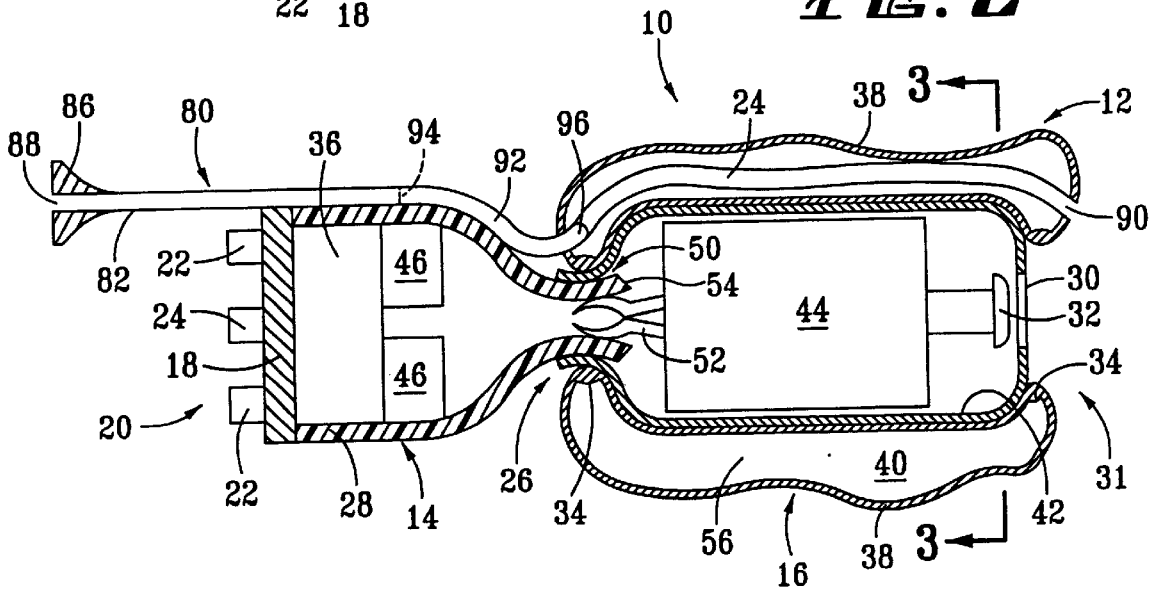
FIG. 2 is a cross section taken along the length of the hearing device of FIG. 1.
Figure 3:
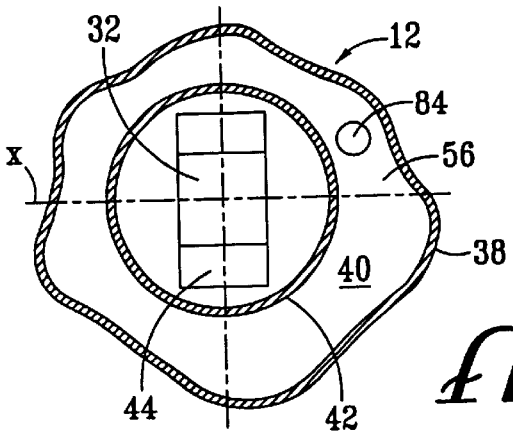
FIG. 3 is a cross section taken along the line A—A in FIG. 2.

Referring to FIGS. 2 and 3, the conformal tip 12 generally comprises an elastic membrane 38 and a compliant, non-compressible material 40. The elastic membrane 38 is generally formed into the shape of an elongate pipe defining a central passage 58 (seen FIG. 4). The walls of the elongate pipe defined by the elastic membrane 38 further define an isolated internal volume 56. The internal volume 56 is filled with the compliant material 40. The pressure of the compliant material 40 within the volume 56 maintains the elastic membrane 38 in a substantially "filled" state. The elastic membrane 38 is preferably nonporous and smooth to facilitate cleaning and minimize the chance of infection when worn for extended periods of time. The membrane 38 can therefore be made of a number of suitable materials including but not limited to elastic urethanes such as Tecoflex™ and Pellethane™. A number of commercially available elastic silicones can be used as well.

Semi-rigid, annular fastening ridges 34 are disposed around the inner diameter of the elastic membrane 38 on both the proximal and distal ends of the receiver module 16. The fastening ridges 34 are made of e.g., silicone, and help to maintain the conformal tip 12 in a "filled" state. The fastening ridges 34 also aid in securing the conformal tip 12 to the receiver housing 16. Alternately, the conformal tip 12 can be secured to the receiver module 16 without the use of fastening ridges 34, but instead due to the resulting friction between the two components.

The receiver module 16 includes a rigid receiver housing 42 substantially enclosed by the conformal tip 12. A receiver unit 44, including the distal speaker 32, is enclosed within the receiver housing 42. The receiver housing 42 may, for example have a generally cylindrical shape and is preferably formed from the same material as the main module housing 28. Similar to the main module housing 28, the receiver housing 42 can also be formed from a medical grade stainless steel or other bio-compatible and moisture resistant material. As described below in conjunction with FIGS. 7 and 8, it is not necessary for the receiver module 16 to be a cylindrical shape. Rather, various other receiver module shapes, each targeted toward a specific hearing device application, are also contemplated with the scope of the present invention.

A tapered opening 50 is provided at the proximal end of the receiver housing 42, which allows access to electrical contact elements 52 connected to the receiver unit 44. The main module 14 includes contact elements 54 coupled with the internal components 36 and 46, and is configured to engage with the receiver contact elements 52 and form an electrical connection. In this manner the sounds captured by the microphone 24 and processed by the sound processing electronics 46 are conveyed to the receiver 44 and subsequently amplified by speaker 32.

In a preferred embodiment, the main module contact elements 54 are inwardly spring biased, while contact elements 52 are outwardly spring biased. The spring biasing ensures a consistent electrical connection is maintained between the respective components. The spring biased connection between main module 14 and the receiver module 16, along with the tapered profile of the opening 50, forms the articulating joint 26. As shown by the directional arrows in FIG. 1, the main module 14 can pivot in any two dimensional plane about the joint 26 as well as rotate about the center axis "x" of the hearing device 10. The possible directions of movement of the main module 14 are represented by arrows $\alpha$, $\beta$ and $\delta$ in FIG. 1. In particular, the articulating joint 26 allows the hearing device 10 to further conform to a variety of ear canal shapes.

Notably, FIGS. 2 and 3 depict the hearing device 10 and more particularly the conformal tip 12 as they would appear when inserted into and subject to deformations caused by, the morphology of the ear canal. The diameter of the hearing device 10 with the engaged conformal tip 12 is preferably somewhat larger than a typical ear canal diameter, whereby the elastic membrane 38 will conform to the contours of the ear canal wall.

In particular, since the compliant material 40 within the membrane 38 is essentially non-compressible (e.g., water, saline, silicone gel, hydrogels or other fluid and elastic polymers) its volume remains constant. Thus, any deformation of the conformal tip 12 caused by compression from the ear canal wall will cause the elastic membrane 38 to stretch, creating a form fit with the contours of the particular ear canal wall, while simultaneously exerting a slight pressure on the ear canal walls. The amount of pressure exerted will vary depending on the elastic properties of the membrane 38. Any displaced volume of the compliant material 40 will squeeze the elastic membrane 38 over the ends of the receiver housing 42, further securing the conformal tip 12 to the receiver housing 42. The respective receiver module 16 and conformal tip 12 thereby form a substantially tight acoustic seal when inserted into the inner portion of an ear canal.

Since the internal lumen portion 84 of the conduit 80 is embedded within the conformal tip 12, it is preferably formed from a sufficiently flexible material that will conform to the changing shape of the conformal tip 12. Similarly, a distal end portion 92 of the tubular body portion 82 is also preferably formed from a more flexible material than the remainder of the body portion 82, so that when the articulating joint 26 moves, the distal end 92 of the conduit 80 will likewise move. Broken line 94 shows a preferred transition point between the flexible material portion 92 and the more rigid material of the remainder of tubular body portion 82.

Moreover, the material that forms the several portions 82, 84 and 92 of the conduit 80 is preferably resilient enough so that a consistent passageway is maintained from the proximal opening 88 to the distal opening 90. The passageway formed by the conduit 80 also allows sound waves that are generated within a user's head to naturally propagate to the ambient environment, thereby significantly reducing or eliminating acoustic feedback to the wearer. Therefore, the conduit 80 simultaneously provides an integrated venting and pressure equalization system, an extraction and insertion aid, and an acoustic feedback suppression system.

Figure 4:
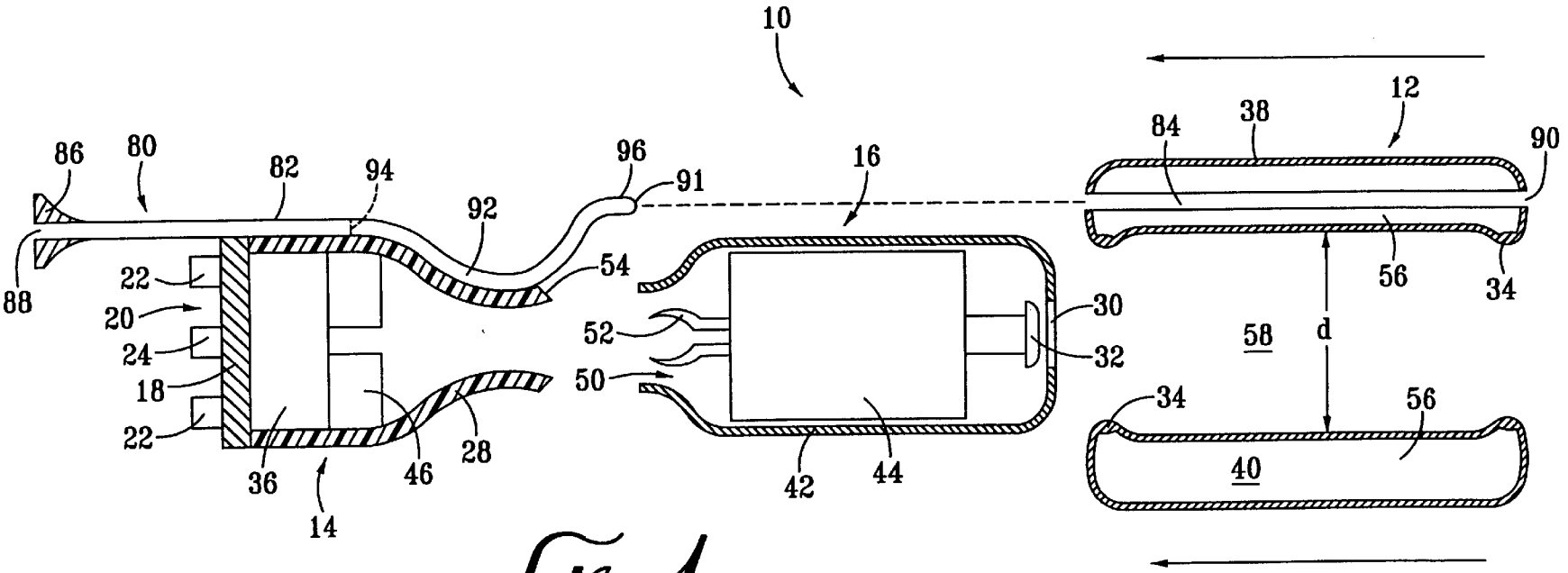
FIG. 4 is an exploded cross section of the hearing device of FIG. 1.

FIG. 4 shows an exploded view of the hearing device 10, including the conformal tip 12, the main module 14, and the receiver module 16. Each of the components 12, 14 and 16 are designed to be easily separated from each other and readily interchanged. Preferably, variously sized conformal tips 12 are available to a physician or audiologist in order to fit a wide range of ear canal sizes. In this manner, a single size receiver housing 42 can be utilized. Only the conformal tips 12 would need to be interchanged to accommodate a particular user's ear canal.

In FIG. 4, the conformal tip 12 is shown in its normally "filled" state without any external force deforming its shape. The internal diameter "d" of the conformal tip 12 is preferably slightly less than the external diameter "D" of the receiver housing 42. When slid over the receiver housing 42, the elastic membrane 38 becomes slightly stretched and will grasp onto the exterior of the housing 42. The respective annular ridges 34 help maintain the shape of the conformal tip, when isolated from the receiver housing 42. Preferably, the receiver housing 42 is sufficiently smooth to allow the conformal tip 12 to easily slide over its outer surface. The conformal tip 12 is preferably configured so that, once engaged with the receiver housing 42, it will not interfere with the operation of filter 30 or speaker 32.

As seen in FIG. 4, the flexible portion 92 of the tubular body 82 of conduit 80 preferably includes a slightly tapered end 96, which facilitates attachment and removal of the tubular body 82 and internal lumen 84.

Figure 5:
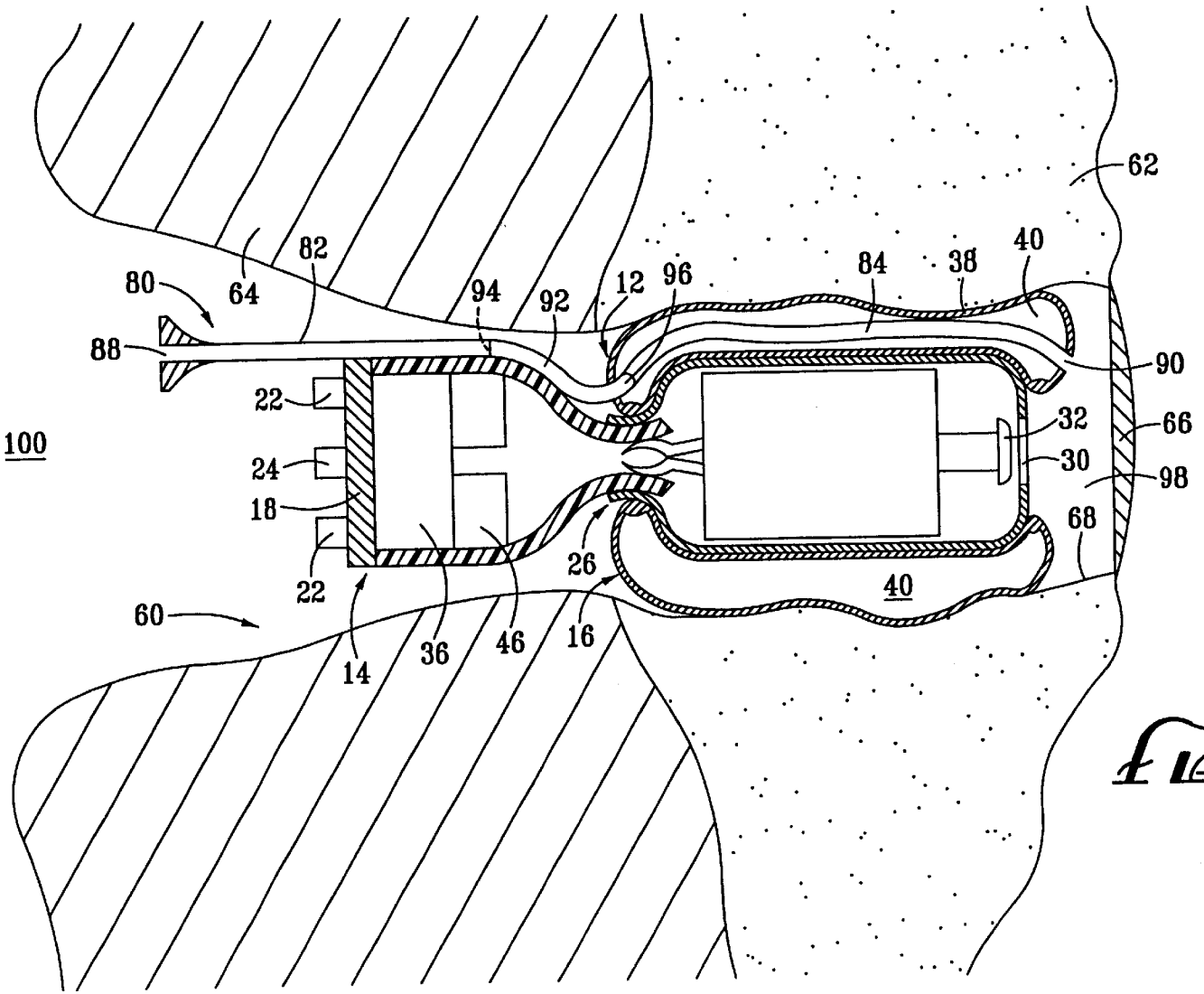
FIG. 5 is a cross sectional view of the hearing device of FIG. 1, taken as it would fit within a user's ear canal.

FIG. 5 shows a hearing device 10 engaged with a conformal tip 12, as it would sit within an ear canal 60. In a preferred embodiment, where the hearing device is a completely-in-the-canal (CIC) hearing device, the receiver module 16 and conformal tip 12 sit substantially within the inner bony portion 62 of the ear canal. In such a position, the receiver module 16, and in particular, the speaker 32, are in close proximity to the tympanic membrane (ear drum) 66. The main module 14 is located within the cartilaginous region 64 of the canal 60, but does not exert pressure on the wall of the ear canal since it is supported by the receiver module 16.

In FIG. 5, the conformal tip 12 is shown as it conforms to the contours of the ear canal wall 68. The overall external diameter of the conformal tip 12 is preferably slightly larger than the diameter of the ear canal 60 along the area where the receiver module is located, so that the elastic membrane 38, is "squeezed" into and conforms to the shape of the ear canal wall 68. In doing so, the conformal tip 12 exerts a slight outward pressure on the ear canal wall 68. Since the membrane 38 is elastic, some of the displaced volume of the compliant material is forced over the edges of the receiver housing 42. Only a slight pressure, sufficient to retain the hearing device 10 within the ear canal, is imparted on the ear canal wall 68. Thus, discomfort to the user is greatly reduced, or altogether eliminated.

The conformal tip 12 of the present invention is not limited to use with a CIC hearing device. For example, FIG. 6 depicts another type of in-the-canal hearing aid utilizing a preferred embodiment of the conformal tip.

Figure 6:
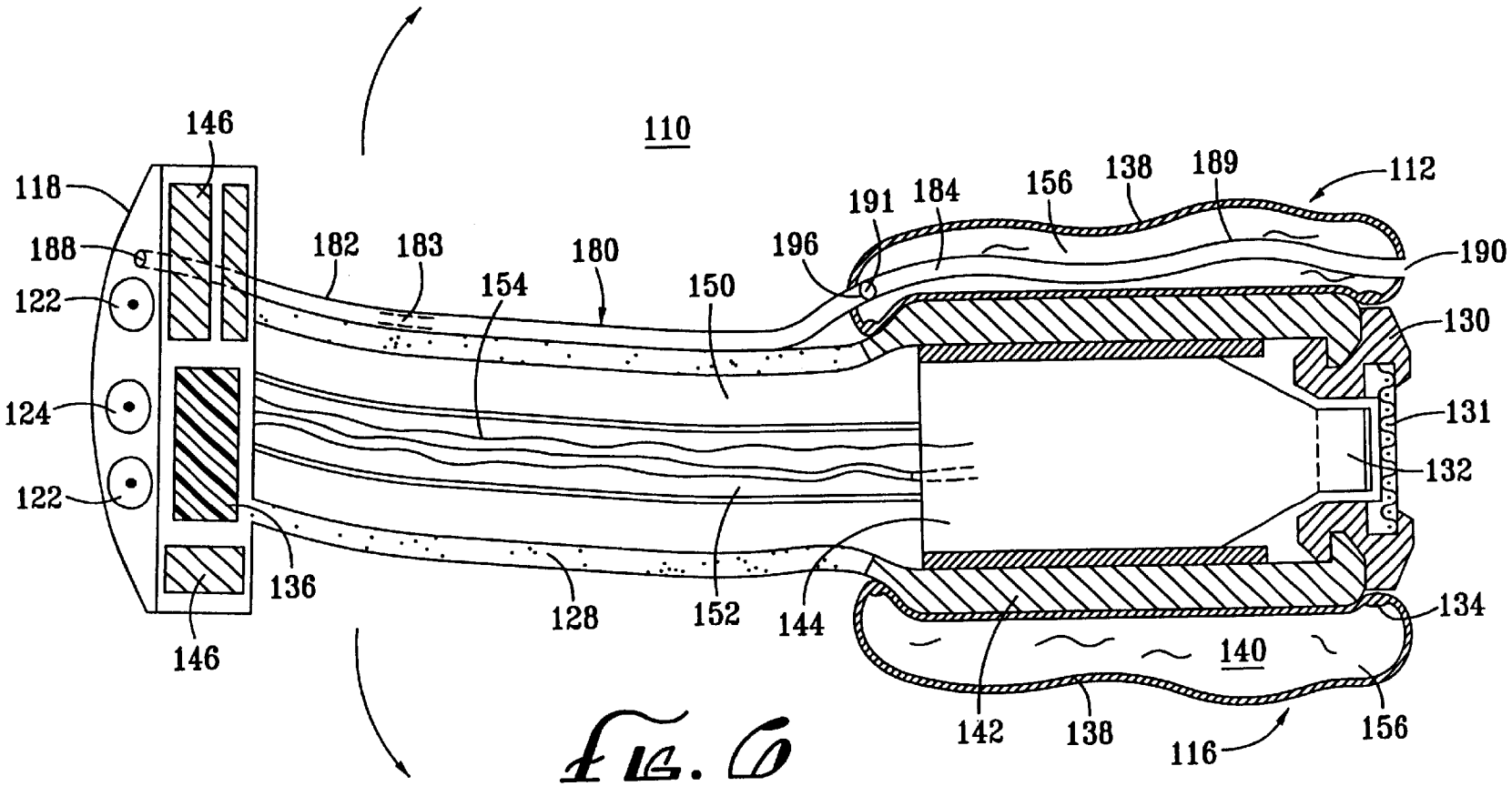
FIG. 6 is a cross sectional view of a preferred embodiment of an in-the-canal (ITC) hearing device utilizing a conformal tip constructed in accordance with the present invention.

Referring to FIG. 6, an elongate, single body in-the-canal (ITC) hearing device 110 employs a conformal tip 112 circumferentially attached around a distal end receiver module 116. The hearing device 110 is configured to extend through the entire length of the ear canal, with a proximal end faceplate housing 118 exposed within the fleshy external portion of the ear canal. The faceplate housing 118 includes controls 122 and a microphone 124. Located within the faceplate housing 118 are sound processing electronics 146 and a battery 136.

The main length of the hearing device 110 is formed from a semi-rigid shell 128 having an internal lumen 150. Within the lumen 150 is located a protective channel 152 for carrying data and electrical wires 154 from the electronics 146 to a receiver unit 144 located within the distal end receiver module 116.

In a preferred embodiment, the semi-rigid shell 128 can be adjusted to fit the shape of a particular ear canal. Co-pending U.S. patent application Ser. No. 09/161,344 filed on Sep. 25, 1998, assigned to the assignee of the present application, and which is fully incorporated herein by reference for all that it teaches, discloses a deformable hearing device shell. In particular, a heat deformable polymeric material is used to form the structure of the hearing device shell. When heated, the polymeric material assumes a plastic state and can be formed to match the precise geometry of an ear canal. When cooled to at or below a normal body temperature, the material returns to its normal glassy state and becomes rigid, thereby retaining the shape of the ear canal.

The receiver module 116, includes a rigid receiver housing 142 which encloses the receiver 144 and speaker 132. The rigid receiver housing 142 is adapted to receive an annular filter housing 130 about its distal end, which includes a hydrophobic and oleophobic replaceable filter membrane 131. Further details of such a filter housing are disclosed in the above-incorporated co-pending U.S. patent application Ser. No. 09/161,344.

In FIG. 6, the conformal tip 112 is shown engaged with the receiver housing 142 in a similar manner as the conformal tip 12 is engaged with the receiver housing 42 in CIC hearing device 10 depicted in FIGS. 1–5. The conformal tip 112 is shown as it would appear when inserted into an ear canal, wherein its shape is deformed along the contours of an ear canal.

The conformal tip 112 includes an elastic membrane 138, which forms an internally isolated volume 156. The volume 156 is filled with a compliant material 140. Semi-rigid, annular fastening ridges 134 are disposed around the inner diameter of both ends of the elastic membrane 138 on both the proximal and distal ends of the receiver module 116. The fastening ridges 134 are made of e.g., silicone, and help to maintain the conformal tip 112 in a "filled" state. The fastening ridges 134 also aid in securing the conformal tip 112 to the receiver housing 116.

When inserted into the ear canal, the membrane 138, filled with the compliant material 140, conforms to the shape and contours of the bony inner ear canal wall, while also exerting a gentle pressure on the same portion of the ear canal wall. The hearing device 110 is thereby secured within the ear canal without causing appreciable pain or discomfort to the user. The hearing device 110 can utilize a single size receiver module 116, while incorporating variously sized conformal tips 112 in order to fit the size of a user's ear canal. As with the previously described device 10, the respective receiver module 116 and conformal tip 112 form a substantially tight acoustic seal when inserted into the inner portion of an ear canal.

A conduit 180 extends from a proximal opening 188 on the exterior surface of the faceplate 118 to a distal opening 190 on the distal end of the receiver module 116. The conduit 180 comprises a tubular body portion 182 attached to the exterior surface of the shell 128 and a lumen portion 184 extending through the conformal tip 112. The tubular body portion 182 forms an internal lumen 183 extending from the proximal opening 188 to a proximal opening 191 of the internal lumen portion 184. The internal lumen portion 184 extends from its proximal opening 191 to the distal opening 190. The respective lumens 183 and 184 are in communication with each other to thereby form a substantially uniform passage from the proximal opening 188 to the distal opening 190.

The tube portion 182 can be separated from the lumen portion 184, and includes a tapered distal end 196 to aid in inserting and removing the tube portion 182 from the lumen portion 184. Since the ITC hearing device of FIG. 6 is not seated deep within the ear canal like a CIC hearing device, it is not necessary to include a retrieval system. The faceplate sufficiently extends to enable a user to grasp its end and remove the hearing device. Since the entire length of the main module rigid housing 128 can be deformed, both the tubular body portion 182 and the wall 189 surrounding the internal lumen portion 184 are preferably made from a sufficiently flexible material to accommodate the deformation.

Figures 7, 8:
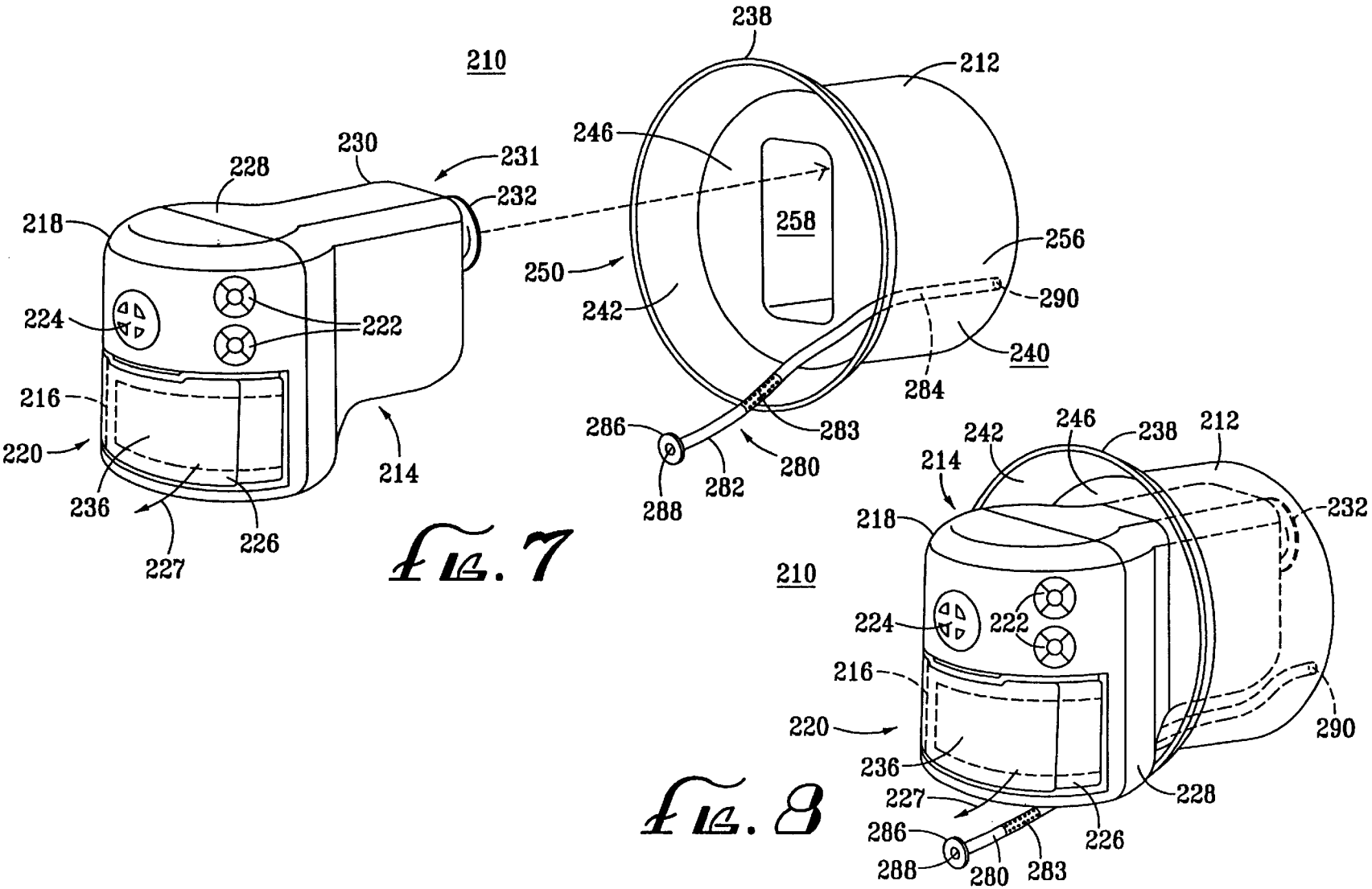
FIG. 7 is an exploded perspective view of a second preferred embodiment of a completely in-the-canal (CIC) hearing device utilizing a conformal tip constructed in accordance with the present invention.
FIG. 8 is a perspective view of the hearing device of FIG. 7 as it engages within the conformal tip.

Notably, the conformal tip contemplate by the present invention is not limited to use with multi-module hearing devices. For example, FIGS. 7 and 8 show a perspective view of a completely in-the-canal (CIC) hearing device 210 utilizing a preferred conformal tip 212. The CIC hearing device 210 includes a single receiver module 214, rather than multiple modules as previously described in conjunction with FIGS. 1–5.

The receiver module 214 preferably comprises a rigid shell 228 formed, e.g., from a plastic, thermoplastic or other polycarbonate material. The rigid shell (or housing) 228 provides a lightweight, durable, bio-compatible housing for internal components of the receiver module 214, including a power source 236, microphone 224, receiver (not shown), speaker 232, and sound processing electronics (not shown). Alternately, the receiver module 214 can be formed from a medical grade stainless steel or other bio-compatible and moisture resistant material. Notably, the housing 228 provides protection of the internal components from moisture, dirt, and oil from cerumen (ear wax).

The receiver module 214 further includes a removable faceplate 218 covering an open end 220 of the housing 228. The faceplate 218 allows access to the components mounted inside of the receiver module 214. Located on the exterior of the faceplate 218 are controls 222 and a microphone 224. Briefly, the controls 222 provide the ability to adjust volume, sensitivity, or sound processing schemes. A compartment 226 is hinged to the receiver module 214 by a pin 216 and is also accessible from the exterior of the faceplate 218. Located within the compartment 226 is a power source 236 preferably in the form of a standard size hearing device battery. The hinged compartment 226 swings outward (as indicated by arrow 227) and allows easy replacement of the battery 236. The distal end 231 of the receiver module 214 further includes a speaker 232, which operates in conjunction with the electronics (not shown) housed within the receiver module 214.

The conformal tip 212 in FIG. 7 generally comprises an elastic membrane 238 and a compliant, non-compressible material 240. The elastic membrane is generally formed into the shape of an elongate pipe defining a central passage 258. The central passage 258 is shaped to easily and accurately fit over the correspondingly shaped portion 230 of the receiver module 214. The central passage 258 is substantially rectangular in shape so as to snuggly engage with the rectangularly shaped portion 230 of the receiver module 214. The walls of the conformal tip 212 defined by the elastic membrane 238 further define an isolated internal area 256 filled with the compliant material 240. The pressure of the compliant material 240 within the area 256 maintains the elastic membrane 238 in a substantially "filled" or expanded state. The elastic membrane 238 is preferably nonporous and smooth to facilitate cleaning and minimize the chance of infection when worn for extended periods of time. The membrane 238 can be made of a number of suitable materials, including but not limited to elastic urethanes such as Tecoflex™ and Pellethane™. A number of commercially available elastic silicones can be used as well.

The conformal tip 212 also includes a portion 242 that extends from the circumference of the proximal end 250 of the conformal tip 212. The portion 242 is preferably formed from the same elastic material 238 and provides a skirt that partially encloses the open end 220 of the receiver module 214 when inserted into the conformal tip 212. The skirted portion 242 aides a user when guiding the receiver module 214 into the conformal tip 212. The proximal surface 246 of the conformal tip 212 allows a user to consistently insert the receiver module 214 into the conformal tip 212.

A conduit 280 serves as both a vent and a retrieval cord for the hearing device 210, and additionally aides in minimizing acoustic feedback. The conduit 280 comprises a proximally extending tubular body portion 282 extending from the proximal surface 246 of the conformal tip 212, and an internal distal lumen portion 284 extending through the conformal tip 212. The tubular body portion 282 and the internal lumen portion 284 together form an internal lumen 283 extending from a proximal opening 288 of the tubular body portion 282 to a distal opening 290, which is located near the distal end 231 of the receiver module 214 when the receiver module 214 is inserted into the conformal tip 212.

The lumen 283 defines a substantially uniform passage from the proximal opening 288 to the distal opening 290.

In particular, when the hearing device 210 is inserted deeply into an ear canal, the lumen 283 allows air and sound waves to flow freely between a chamber (reference number 98 in FIG. 5) formed between the distal end 231 of the receiver module 214 and the tympanic membrane, and the ambient air. Due to the air tight seal formed between the conformal tip 212 and the ear canal wall, pressure builds up in the deep portion of the ear canal, near the tympanic membrane. The passage created by the conduit 280 prevents an increase in this pressure by acting as a vent between the deep portions of the ear canal and the ambient air.

In addition to providing a pressure vent for the hearing device 210, the conduit 280 also allows a user, physician or audiologist to easily insert and remove both the receiver module 214 and the conformal tip 212, from within the ear canal. In particular, the proximal end of the tubular body portion 282 extends proximally (i.e. towards the opening of the ear when the device is inserted in an ear canal) beyond the operative end 220 of the receiver module 214. This proximally extending portion of the tubular body portion 282 is preferably long enough so that the wearer can grasp it securely between two fingers and remove (i.e. pull) the hearing device 210 from the ear canal. The proximal end of the tubular body portion 282 includes a circumferentially raised section 286 to further aid a user in grasping the conduit 280.

In order to effectively remove both the conformal tip portion 212 and the receiver module portion 214, the internal lumen portion 284 of the conduit 280 is firmly engaged to the conformal tip 212. Preferably, the internal lumen portion is bonded to the elastic membrane 238 by a suitable adhesive. The resulting structural integrity of the conduit 280 eliminates the need to have a bully structure in the conformal tip 212.

While the embodiment shown in FIGS. 7 and 8 shows the conduit forming a portion of the conformal tip portion 212, the conduit 280 can alternately be bonded to and form a part of the receiver module 214. In this manner, the conformal tip portion would slide over both the receiver module 214 and the conduit 280.

FIG. 8 shows the receiver module 214 while engaged within the conformal tip 212 and, particularly, how the proximal surface 246 limits the insertion distance of the receiver module 214. The skirted extension 242 is also shown partially enclosing the receiver module 214.

Although the invention has been described and illustrated in the above description and drawings, it is understood that this description is by example only and that numerous changes and modifications can be made by those skilled in the art without departing from the true spirit and scope of the invention. The invention, therefore, is not to be restricted, except by the following claims and their equivalents.

What is claimed is:

1. A hearing device, comprising:

a first module having an external surface;

a second module removably attached to the first module;

an elongate tubular body secured along the external surface of the first module and comprising a first lumen, the tubular body having a proximal opening in communication with the first lumen; and a second lumen extending through the second module, the second module having a distal end opening in communication with the second lumen, wherein the tubular body is removably attached to the second module such that the first and second lumens are in communication to thereby form a conduit extending from the proximal tubular body opening to the distal end opening of the second module.

2. The hearing device of claim 1, wherein the first module houses a microphone, battery and sound processing electronics and wherein the second module houses an audio speaker.

3. The hearing device of claim 1, wherein the tubular body further comprises a substantially rigid proximate section and a flexible distal section.

4. The hearing device of claim 1, wherein conduit formed by the respective first and second lumens attenuates acoustic feedback when the device is positioned in an ear canal.

5. The hearing device of claim 1, wherein the conduit formed by the respective first and second lumens provides a pressure equalization vent when the device is positioned within an ear canal.

6. The hearing device of claim 1, wherein the second module comprises a substantially rigid housing having a generally cylindrical surface, and a conformal tip portion surrounding the generally cylindrical surface, the second lumen extending through the conformal tip portion.

7. The hearing device of claim 1, wherein the tubular body extends from the first module in a direction distal to the second module, such that the tubular body provides a mechanism to facilitate removal of the hearing device from an ear canal.

8. The hearing device of claim 1, wherein the respective first module and tubular body are attached to the second module in a manner allowing the second module to rotate relative to the first module.

9. An in-the-canal hearing device, comprising:

a first module having an external surface and including a microphone;

a second module including an audio speaker, the second module removably attached to the first module;

an elongate tubular body secured along the external surface of the first module and removably attached to the second module, the tubular body having a proximal opening and a first lumen in communication with the proximal opening; and a second lumen extending through the second module, the second module having a distal end opening in communication with the second lumen, wherein the first and second lumens are in communication to thereby form a conduit extending from the proximal tubular body opening to the distal end opening of the second module, the conduit providing a pressure equalization vent when the device is positioned within an ear canal.

10. The hearing device of claim 9, wherein the tubular body further comprises a substantially rigid proximate section and a flexible distal section.

11. The hearing device of claim 9, wherein the conduit formed by the respective first and second lumens attenuates acoustic feedback when the device is positioned in an ear canal.

12. The hearing device of claim 9, wherein the second module comprises a substantially rigid housing having a generally cylindrical surface, and a conformal tip portion surrounding the generally cylindrical surface, the second lumen extending through the conformal tip portion.

13. The hearing device of claim 9, wherein the tubular body extends from the first module in a direction distal to the second module, such that the tubular body provides a mechanism to facilitate removal of the hearing device from an ear canal.

14. The hearing device of claim 9, wherein the respective first module and tubular body are attached to the second module in a manner allowing the second module to rotate relative to the first module.

* * * * *